US009101788B2

(12) United States Patent
Allan et al.

(10) Patent No.: US 9,101,788 B2
(45) Date of Patent: Aug. 11, 2015

(54) CASE FOR EMERGENCY ESCAPE BREATHING APPARATUS

(75) Inventors: Jason E. Allan, Tyne & Wear (GB); Michael R. Peel, Tyne & Wear (GB)

(73) Assignee: Draeger Safety UK Limited, Northumberland (GB)

( * ) Notice: Subject to any disclaimer, the term of this patent is extended or adjusted under 35 U.S.C. 154(b) by 667 days.

(21) Appl. No.: 13/369,730

(22) Filed: Feb. 9, 2012

(65) Prior Publication Data

US 2012/0204868 A1 Aug. 16, 2012

(30) Foreign Application Priority Data

Feb. 10, 2011 (GB) ..... 1102381.9
Oct. 14, 2011 (GB) ..... 1117756.5

(51) Int. Cl.
*A62B 25/00* (2006.01)
*A62B 9/00* (2006.01)
*A62B 7/00* (2006.01)

(52) U.S. Cl.
CPC . *A62B 25/00* (2013.01); *A62B 7/00* (2013.01); *A62B 9/00* (2013.01)

(58) Field of Classification Search
CPC . A61M 16/10; A61M 11/06; A61M 16/0057; A61M 15/0065; A61M 16/00; A61M 15/00; A61M 15/008; A61M 15/02; A61M 15/025; A61F 17/00; A61F 5/00; A61F 5/0096; A61B 19/0266; A61B 19/0264; A61B 19/00; A61B 19/02; A61B 5/0205; A45C 13/02; A45C 13/00; A41D 13/0012; A41D 13/00; A62B 7/14; A62B 7/00; A62B 7/04; A62B 9/00; A62B 9/02; A62B 9/022; A62B 9/04; A61N 1/39; B64D 11/00; B64D 13/00; B64D 13/02; B65D 23/12; B05B 12/00; B05B 12/004; B05B 12/08; B05B 5/00; B05B 5/025; B05B 5/0255; B05B 5/053; B05B 5/16; B05B 5/1691; B08B 3/04; B08B 3/06; B63C 11/02; B63C 11/22; B63C 11/2209; D06F 41/00
USPC ..... 128/200.14–200.24, 203.12, 203.15, 128/204.18, 204.21, 204.26, 205.22, 128/205.25, 206.21
See application file for complete search history.

(56) References Cited

U.S. PATENT DOCUMENTS 2,831,607 A 4/1958 Berndt
2,866,456 A 12/1958 Lovy et al.

(Continued)

FOREIGN PATENT DOCUMENTS

DE 3814070 11/1989
DE 3814070 A1 11/1989

(Continued)

OTHER PUBLICATIONS http://www.jmwlimited.co.uk/Draeger_Saver_PP_Escape_Set.html dated May 15, 2008.

(Continued)

*Primary Examiner* — Annette Dixon
(74) *Attorney, Agent, or Firm* — DLA Piper LLP (US)

(57) ABSTRACT

A case for an emergency escape breathing apparatus including a substantially rigid hollow shell defining a cylinder housing portion for retaining a cylinder of breathable gas and a delivery device housing portion for removably housing a delivery device for the breathable gas supplied by the cylinder. An access opening is provided which provides access to the interior of the delivery device housing portion through which a delivery device, such as a hood or mask, can be inserted and removed.

26 Claims, 5 Drawing Sheets

(56) References Cited

U.S. PATENT DOCUMENTS

| | | | | | |
|---|---|---|---|---|---|
| 3,800,819 | A | * | 4/1974 | McKee | 137/343 |
| 3,981,302 | A | * | 9/1976 | Veit | 128/202.26 |
| 4,196,725 | A | | 4/1980 | Gunderson | |
| 4,241,833 | A | * | 12/1980 | Luebcke | 206/570 |
| 4,243,155 | A | | 1/1981 | Stewart | |
| 4,257,415 | A | * | 3/1981 | Rubin | 128/200.21 |
| 4,788,973 | A | * | 12/1988 | Kirchgeorg et al. | 128/204.18 |
| 5,299,565 | A | * | 4/1994 | Brown | 128/200.21 |
| 5,676,135 | A | | 10/1997 | McClean | |
| 6,684,879 | B1 | * | 2/2004 | Coffee et al. | 128/200.14 |
| 7,350,520 | B1 | * | 4/2008 | Richard-Bey | 128/200.21 |
| 2005/0011520 | A1 | | 1/2005 | Rowe | |
| 2007/0045152 | A1 | | 3/2007 | Kwok et al. | |

FOREIGN PATENT DOCUMENTS

| | | |
|---|---|---|
| DE | 29503894 UI | 4/1995 |
| GB | 0878119 | 9/1961 |
| GB | 2275613 | 9/1994 |
| WO | 03/105720 | 12/2003 |
| WO | 2004/084981 | 10/2004 |
| WO | 2007/045905 | 4/2007 |

OTHER PUBLICATIONS

UK Search Report dated May 11, 2011.
UK Search Report dated Jan. 18, 2012.
Corresponding European Search Report dated Apr. 8, 2013.

* cited by examiner

CASE FOR EMERGENCY ESCAPE BREATHING APPARATUS

CROSS REFERENCE TO RELATED APPLICATIONS

This application claims the priority of UK Patent Application No. 1102381.9, filed on Feb. 10, 2011, and UK Patent Application No. 1117756.5, filed on Oct. 14, 2011, the entire contents of which are incorporated by reference herein.

BACKGROUND OF THE INVENTION

The invention relates to a case for an emergency escape breathing apparatus.

An emergency escape breathing apparatus is intended to enable a user to escape from a polluted or hazardous environment. Such environments may arise following an industrial accident, natural disaster, fire or other situation in which potentially toxic substances are released into the atmosphere, for example, in the form of gases, particulate dispersions, etc. An emergency escape breathing apparatus typically comprises a source of breathable gas, a hood or mask to be placed over the head of a user, and a flexible supply line to deliver breathable gas from the source to the hood or mask. The device is activated by placing the hood or mask over the head and then opening a valve to start the flow of breathable gas through the supply line to the hood or mask. While breathing through the hood or mask, the user then evacuates from the hazardous environment, carrying the source of breathable gas. The source of breathable gas is not generally particularly large, usually containing between 10 and 15 minutes of breathable air. This amount is sufficient to enable a user to evacuate to a place of safety, without being too big and heavy to allow easy carrying by the user.

An emergency escape breathing apparatus is thus not designed for regular or continual use. Such apparatus is provided, and may be legally required, in environments where the potential for hazardous conditions exists. The apparatus enables evacuation from such environments in the event of an emergency, its use being envisaged only in exceptional circumstances. Particular design constraints apply to equipment of this nature, which may remain in storage for an extended period of time but must always to be ready for use in the event of an emergency. Storage is a particular issue, as the apparatus must be readily visible and available in the event of an emergency, without getting in the way of day to day operations. Additionally, the apparatus must be sufficiently light weight to be carried by a user, who may be in physical distress, yet robust enough to withstand rigorous movement in the event of use, and potential accidental damage that may occur as a result of being stored in a high profile and possible busy location. Finally, the apparatus must be sufficiently simple in operation to be used by untrained personnel in the event of an emergency.

To date, it has proved difficult to adequately fulfil all of the above design requirements. An existing emergency escape breathing apparatus may be contained within a high visibility bag, which is light and easy to carry but is subject to damage. Dedicated storage units must be supplied to house the apparatus, potentially occupying valuable space in industrial environments where space may be at a premium. In seeking to address these issues, it may be that ease of use is compromised, or simply that the apparatus becomes costly to manufacture and maintain, a considerable disadvantage in safety equipment that may only rarely be called upon.

SUMMARY OF THE INVENTION

An exemplary embodiment of the present invention comprises a case for an emergency escape breathing apparatus, including a substantially rigid hollow shell defining a cylinder housing portion for retaining a cylinder of breathable gas and a delivery device housing portion for removably housing a delivery device for the breathable gas supplied by the cylinder; and an access opening providing access to the interior of the delivery device housing portion through which a delivery device can be inserted and removed.

An exemplary embodiment of the present invention also comprises a case for an emergency escape breathing apparatus including a substantially rigid hollow shell formed from a plastics material defining a cylinder housing portion for retaining a cylinder of breathable gas and a delivery device housing portion for removably housing a delivery device for the breathable gas supplied by the cylinder, the shell comprising first and second shell parts comprising two halves of the shell which are substantially longitudinally coextensive with one another and which are arranged to assembled around a cylinder of breathable gas so as to cooperatively retain the cylinder therebetween within the cylinder housing portion; an access opening providing access to the interior of the delivery device housing portion through which a delivery device can be inserted and removed; an access panel arranged to close the access opening and at least partially detachable from the shell so as to expose the access opening; and a strap attached to the shell and arranged to be received on the body of a wearer.

An exemplary embodiment of the present invention also comprises an emergency escape breathing apparatus including a cylinder of breathable gas; a delivery device fluidically connected to the cylinder by a supply line; and a case including a substantially rigid hollow shell formed from a plastics material defining a cylinder housing portion which retains the cylinder of breathable gas and a delivery device housing portion which removably houses the delivery device; the shell comprising first and second shell parts comprising two halves of the shell which are substantially longitudinally coextensive with one another and that are assembled around the cylinder of breathable gas so as to cooperatively retain the cylinder therebetween within the cylinder housing portion; an access opening providing access to the interior of the delivery device housing portion through which the delivery device can be inserted and removed; an access panel arranged to close the access opening and at least partially detachable from the shell so as to expose the access opening; and a strap attached to the shell and arranged to be received on the body of a wearer.

BRIEF DESCRIPTION OF THE DRAWINGS

The invention will be better understood with reference to the following detailed description, of which the following drawings form an integral part.

DETAILED DESCRIPTION

Figure 1:
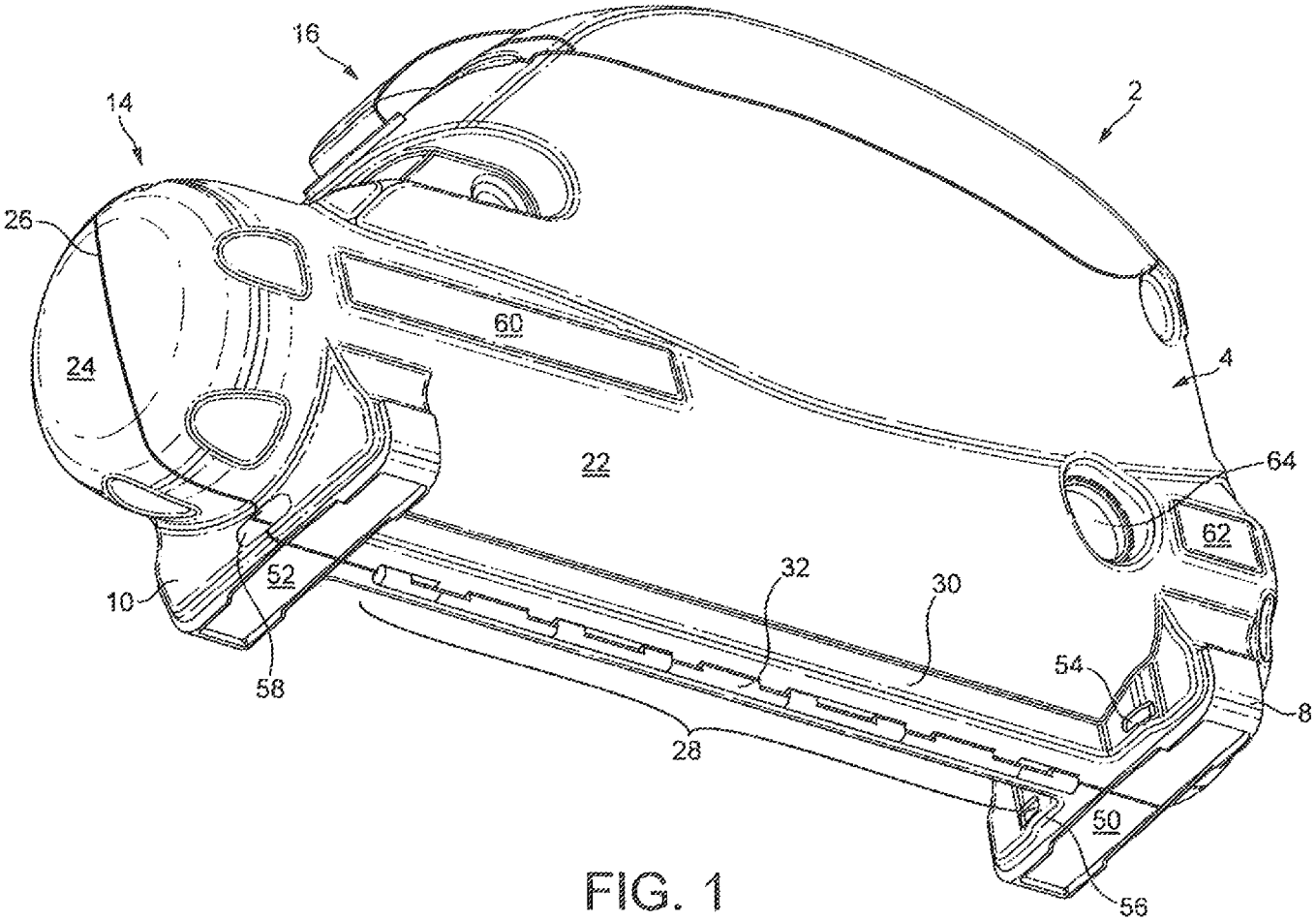
FIG. 1 is a perspective view of a case for emergency escape breathing apparatus.

According to an aspect of the invention there is provided a case for an emergency escape breathing apparatus, comprising: a substantially rigid hollow shell defining a cylinder housing portion for retaining a cylinder of breathable gas and a delivery device housing portion for removably housing a delivery device for the breathable gas supplied by the cylinder; and an access opening providing access to the interior of the delivery device housing portion from which a delivery device can be removed. The shell may comprise first and second shell parts that in use are assembled around a cylinder of breathable gas so as to cooperatively retain the cylinder therebetween within the cylinder housing portion.

The first and second shell parts, also known as component parts, may, for example, comprise two halves of the shell which may be connected to form the complete shell.

The first and second shell parts may be secured together by at least one bolt. Additionally or alternatively, pins or other suitable connecting elements may be used.

The first and second shell parts may be substantially longitudinally coextensive with one another. The first and second shell parts may be substantially mirror images of one another. The first and second shell parts may join along a longitudinally extending plane. The plane may divide or bisect both the cylinder housing portion and the delivery device housing portion.

The first and second shell parts may comprise cooperating formations, operable to interlock. Such cooperating formation may, for example, comprise corresponding lugs and recesses formed along a connecting edge, or any other suitable formation to allow interlocking of adjacent areas of the first and second shell parts.

The first and second shell parts may be joined by a hinge arrangement.

The shell may be formed from a plastics material and may be formed from a conductive plastics material. Such a material has the advantage of eliminating any potential electrostatic hazard, for example, in an environment requiring intrinsically safe equipment.

The first and second shell parts may be integrally formed with one another. The shell may be formed from a moulded component or components and may, for example, be injection moulded.

The shell may further comprise internal fixing elements operable to retain a cylinder of breathable gas within the housing chamber. Such elements may cooperate to clamp the cylinder in position within the housing chamber. The fixing elements may impart additional stability and rigidity to the housing chamber and/or the cylinder, ensuring the cylinder is securely retained in the shell even during the rigorous movement that may take place during use of the apparatus.

The shell may further comprise an opening giving access to the housing chamber. The case may further comprise an access panel arranged to close the access opening and may be at least partially detachable from the shell so as to expose the access opening.

The access panel may comprise a sliding panel, a lid or a fabric strip, and may, for example, include a tab portion for grasping by a user in order to facilitate removal of the access panel and access to the interior of the housing chamber.

The access panel may be at least partially detachable from the shell by tearing. For example, the access panel may comprise pre-formed lines of weakness along which it is predisposed to fail under a tearing action performed by a user.

Alternatively, the access panel may be detachably sealed to the shell. For example, a temporary fixation device such as a hook and loop fastener (e.g., VELCRO®) may be employed to seal the access panel to the shell.

The case may further comprise an activation key, which may be operably connected to the access panel. The activation key may be arranged to open a valve on the cylinder of breathable gas to start the flow of breathable gas into the delivery device. The operable connection between the access panel and the activation key may be such that at least partial detachment of the access panel causes the activation key to open the valve and start the flow of breathable gas.

The case may further comprise a strap attached to the shell which is arranged to be received on the body of a wearer. The strap may be a shoulder strap or a waist strap.

The strap of the case may be a body strap, for example, to fit around the neck, or over the head and shoulder of a wearer, as appropriate. Alternatively, the strap may comprise a component part of a harness.

The strap may be formed from any suitable fabric material. The strap may be treated to ensure fire retardant or other desirable characteristics.

The strap may be attached to the shell via the bolts that connect the first and second shell parts of the shell.

The case may further comprise an external mounting element connected to the shell for mounting the case to a mounting surface. The Mounting element of the case may comprise a projecting lug which may be formed on an external surface of the shell.

A mounting recess may extend through the lug, and may be operable to receive a mounting projection on a corresponding mounting surface.

The mounting lugs may be shaped, for example, to engage a wall or other mounting surface, so as to stabilise the case in a mounted or resting position.

The mounting element may comprise a loop formed on an external surface of the shell.

The case may comprise a plurality of mounting elements, which may be located on the case so as to impart additional stability to the case when in a mounted position.

The shell may further comprise a viewing window which may be positioned to correspond to a gauge location on a cylinder housed within the shell.

The shell may further comprise at least one external patch of photo-luminescent material. The patch may, for example, comprise a strip of photo-luminescent material or fabric, or a painted patch of photo-luminescent paint or ink.

The shell may be operable to house a cylinder containing not more than 30 minutes of breathable gas. For example, the shell may be operable to house a cylinder containing 10 or 15 minutes of breathable gas.

According to another aspect of the invention, there is provided an emergency escape breathing apparatus comprising: a case in accordance with any statement herein; a cylinder of breathable gas; and a delivery device fluidically connected to the cylinder by a supply line; wherein the first and second shell parts are assembled around the cylinder of breathable gas so as to cooperatively retain the cylinder therebetween within the cylinder housing portion; and wherein the delivery device is removably housed within the delivery device housing portion and removable through the access opening.

The delivery device may, for example, be a mask or hood and may comprise a viewing panel and a seal, operable to seal against the head or neck of a wearer.

According to a further aspect of the invention, there is provided a case for an emergency escape breathing apparatus, comprising: a substantially rigid shell defining a housing chamber; an external mounting element connected to the shell; and a strap attached to the shell and operable to be received on the body of a wearer; wherein the shell is operable to house a cylinder of breathable gas and an associated delivery device within the housing chamber.

With reference to FIGS. 1 to 5, a case 2 for an emergency escape breathing apparatus comprises a substantially rigid hollow shell 4 that defines an internal housing chamber 6, upper and lower mounting elements 8, 10 integrally formed on an external surface of the shell 4, and a body strap 12, connected to and extending over the shell 4.

The shell 4 is formed from a plastics material such as Nylon. The shell 4 may be moulded, for example, by using injection moulding techniques. According to one embodiment, the shell 4 is formed from a conductive plastics material, thus eliminating potential electrostatic hazards.

With particular reference to FIGS. 1 to 4, the shell 4 comprises a cylinder housing portion 14 and a delivery device retaining portion 16 extending from and integrally formed with the cylinder housing portion 14. The cylinder housing portion 14 is substantially cylindrical in form and is dimensioned to accommodate a cylinder of breathable gas 20, as is explained in further detail below. The delivery device retaining portion 16 extends from the cylinder housing portion 14 along at least a portion of the length of the cylinder housing portion and across substantially the entire width of the cylinder housing portion. The internal volumes of the cylinder housing portion 14 and delivery device retaining portion 16 are in communication and together form the internal housing chamber 6 of the shell 4.

The shell 4 is formed from first and second shell parts 22, 24 that are detachably attached to one another to form the complete shell 4. Each shell part 22, 24 comprises a semi cylindrical region that when assembled constitutes a longitudinal shell part of the cylinder housing portion 14, and a projecting region that when assembled forms a longitudinal shell part of the delivery device retaining portion 16. The first and second shell parts 22, 24 thus represent a substantially longitudinal division of the shell 4, with the interface 26 between the first and second shell parts 22, 24 extending around the entire circumference of the shell 4. The two shell parts 22, 24 may be at least partially joined along a line of interaction 28 that extends longitudinally along at least part of the length of the cylinder housing portion 14, on a surface of the cylinder housing portion 14 that is opposite to the delivery device retaining portion 16. In the embodiment illustrated in FIG. 1, this surface constitutes a bottom surface of the case 2, as explained below. The shell 4 may comprise a raised keel 30 extending along this line of interaction 28, projecting out of the cylindrical surface of the cylinder housing portion 14. In one embodiment, the two shell parts 22, 24 of the shell 4 are joined by a hinge arrangement at the line of interaction 28, the two shell parts 22, 24 being integrally formed as a single component. In another embodiment, the two shell parts 22, 24 comprise cooperating features that interlock to form a hinge 32 or other connection at the line of interaction 28, as illustrated in FIG. 1. The connection at the line of interaction 28 permits a certain amount of pivotal movement between the shell parts 22, 24 about the line of interaction 28, such that the shell parts may "open" to admit emergency escape breathing apparatus, such as a cylinder of breathable gas, to be securely mounted within the case 2, as explained below. In an assembled condition, the two shell parts 22, 24 of the shell 4 are held together by first and second bolts 34, 36 that extend across the width of the shell 4, forcing the shell parts 22, 24 together.

Figure 4:
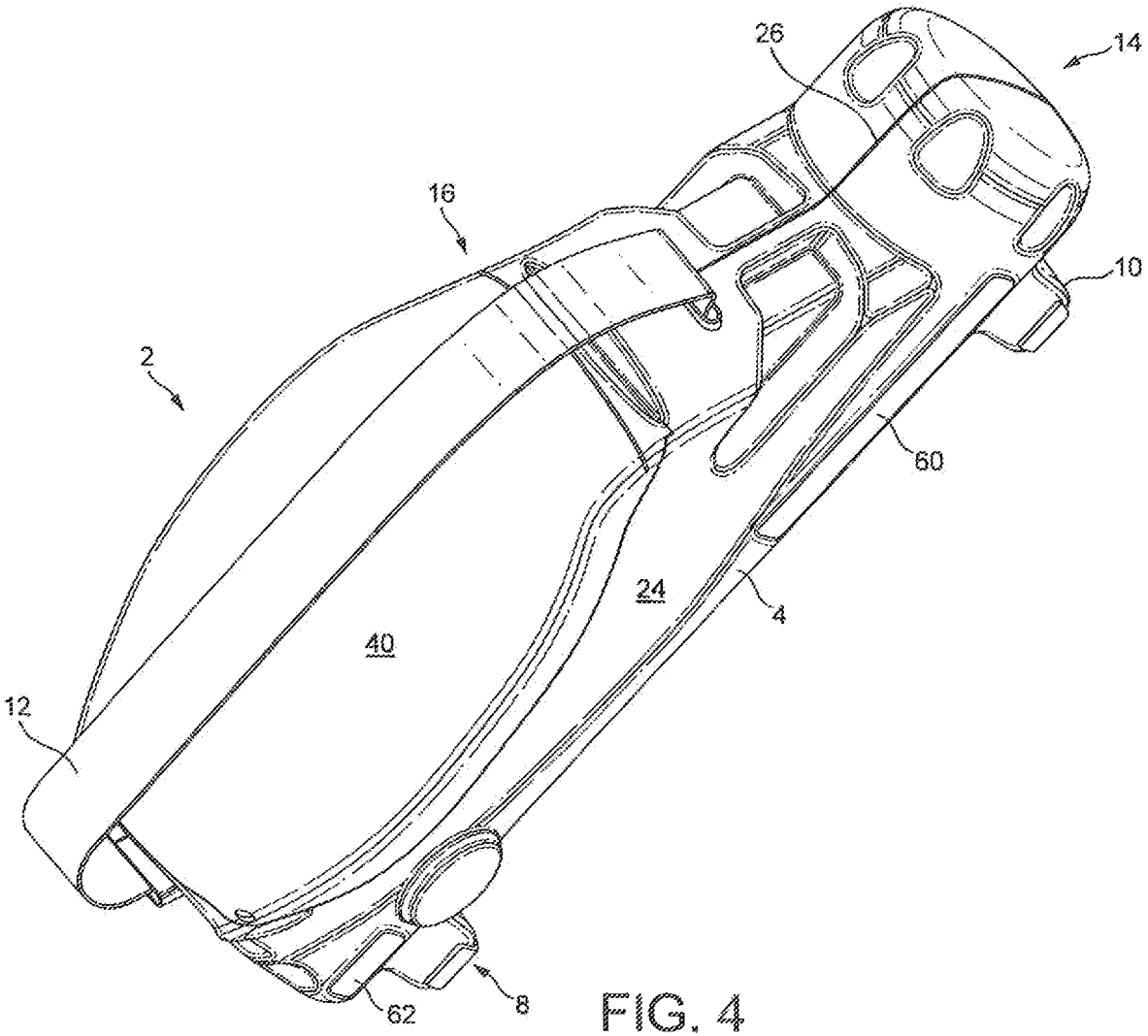
FIG. 4 is another perspective view of the case of FIG. 1.
Figure 5:
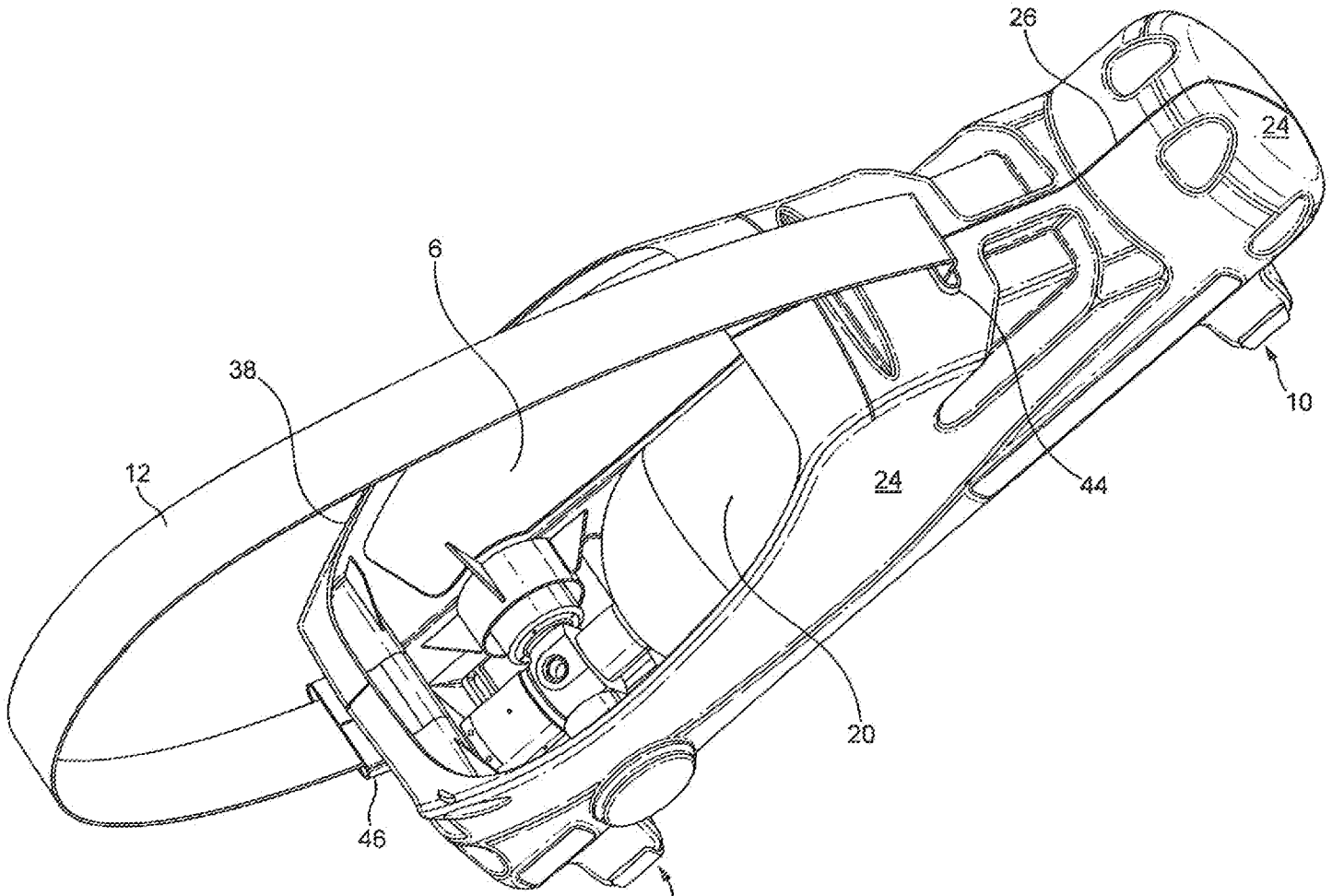
FIG. 5 is a perspective view showing an internal volume of the case of FIG. 1.

The shell 4 further comprises an opening 38 extending through the shell 4 and giving access to the internal housing chamber 6 of the shell 4. The opening 38 is formed in a surface of the delivery device retaining portion 16 that is opposite to the cylinder housing portion 14 and constitutes an upper surface of the case, as seen in FIGS. 4 and 5. The opening 38 is centrally located on the upper surface and is defined in part by the first shell part 22 of the shell 4 and in part by the second shell part 24 of the shell 4. In one embodiment, the opening 38 extends across substantially the entire width of the shell 4 and at least half of the length of the shell 4. The opening is dimensioned to admit passage and removal of a delivery device such as a mask or hood that is stored in the delivery device retaining portion 16 of the shell 4, as discussed below. The opening 38 is normally closed by a closure 40 that extends completely across the opening 38 to removably seal the opening 38. In one embodiment, the closure 40 comprises a fabric strip that is detachable from the shell 4. The strip may be formed from a tearable fabric which may have pre-formed lines of weakness (not shown) manufactured into the fabric, along which the strip is predisposed to fail when subjected to a removal force. Alternatively, the fabric strip may be detachably sealed to the shell 4, for example, by a frangible solvent or a removable fastening arrangement such as a hook and loop fastener (e.g., VELCRO®). The strip may include a transparent panel to facilitate examination of the contents of the shell 4. In other embodiments, the closure may comprise a rigid closure 40, formed from the same rigid plastics material as the shell 4. The rigid closure may be detachably sealed to the shell as discussed above. The closure 40 may comprise a tab or handle 42 to facilitate gripping and removal by a user.

With reference to FIG. 5, the internal surfaces of the shell 4 comprise internal fixing elements operable to grip or otherwise retain a cylinder of breathable gas 20 within the shell 4. The fixing elements may be integrally formed on the shell 4, for example, at the time of moulding. In one embodiment, the fixing elements may comprise the internal surface of the shell 4 itself, the cylinder housing portion 14 of the shell 4 being dimensioned such that, once the two halves of the shell are bolted together around a cylinder of breathable gas 20, the cylinder is held securely within the shell 4 and removal of the cylinder 20 is not possible without disassembly of the shell 4 into its component shell parts 22, 24. The integration of internal fixing elements enables multiple configurations of breathing apparatus to be accommodated within the shell without the requirement for adjustment or additional fixing methods.

With reference to FIGS. 1 and 5, the strap 12 is connected to the shell 4 at first and second connecting points 44, 46 located on the delivery device retaining portion 16 of the shell 4. The strap 12 thus extends over the delivery device retaining portion 16. As seen in FIG. 5, the connecting points 44, 46 comprise openings in the delivery device retaining portion 16 of the shell 4, giving access to the first and second bolts 34, 3,6 that connect the two shell parts 22, 24 of the shell 4 together. Each end of the strap 12 extends around a respective one of the first and second bolts 34, 36 and is secured to itself, forming a loop around the first or second bolts 34, 36. The strap may be formed from a resilient flexible material such as webbing. The strap may be coated with additional agents to ensure fire resistance or other desirable properties.

Figure 2:
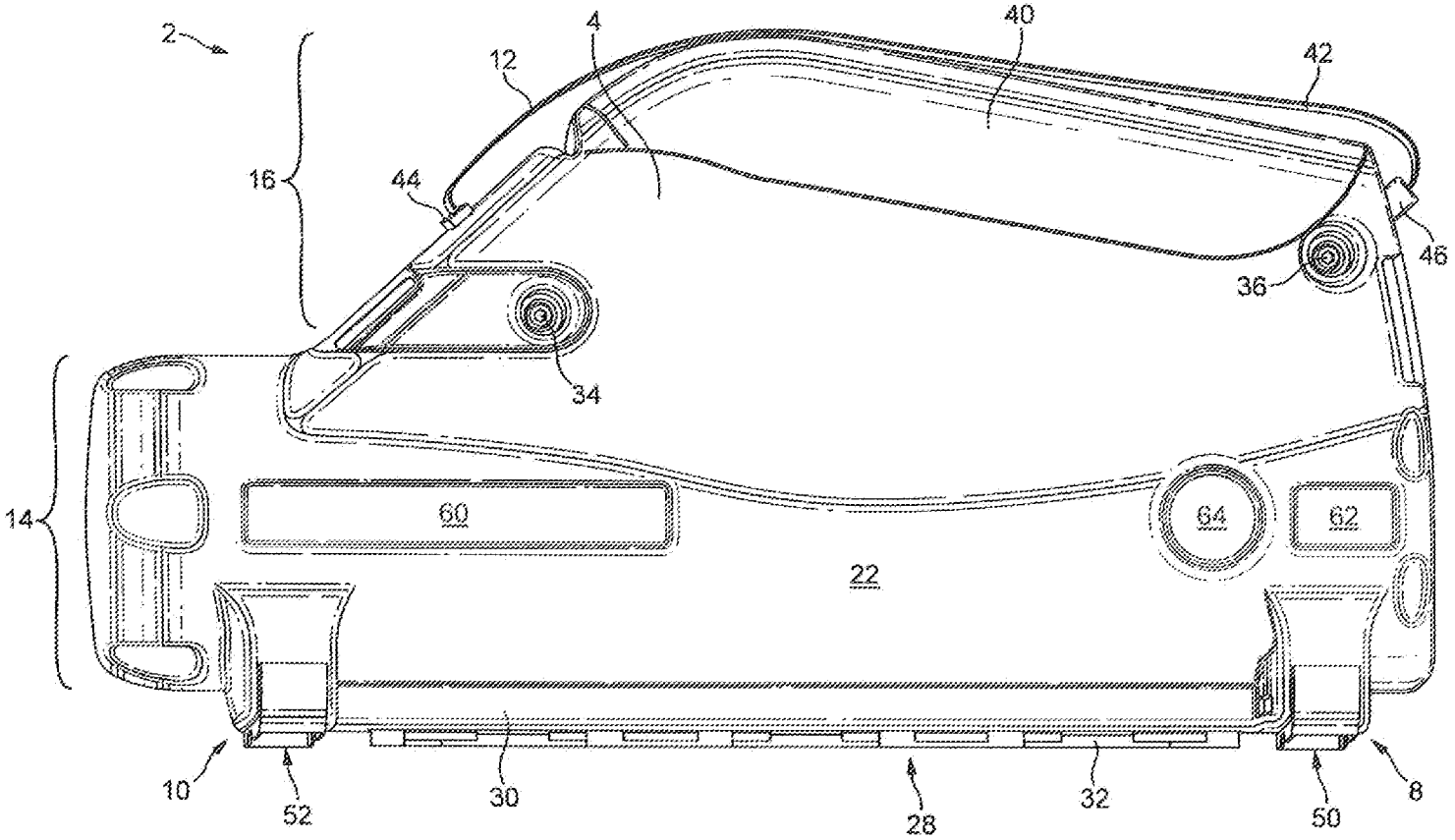
FIG. 2 is a side view of the case of FIG. 1.
Figure 3:
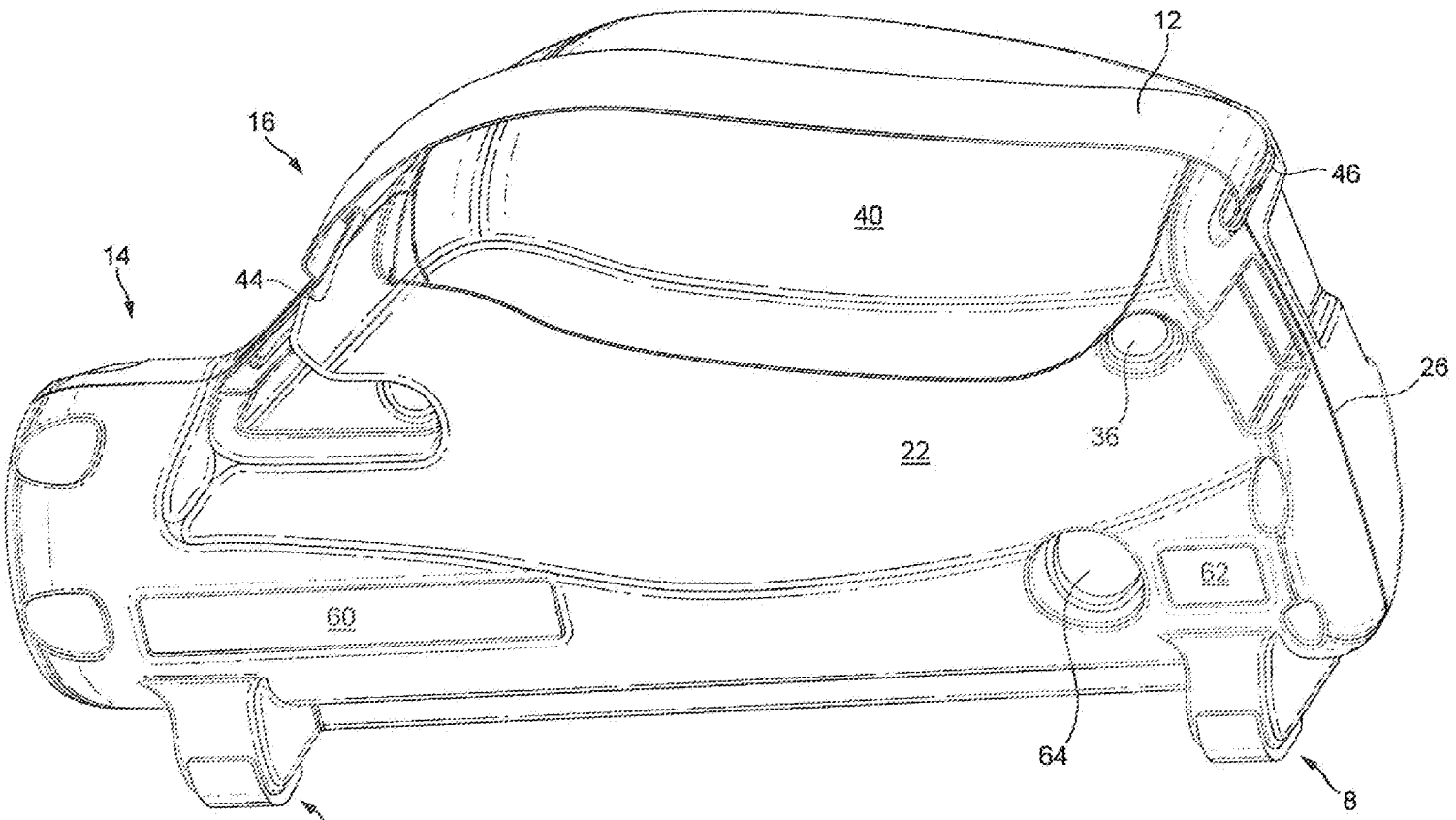
FIG. 3 is another perspective view of the case of FIG. 1, showing a top surface.

With particular reference to FIGS. 1 and 2, the upper and lower mounting elements 8, 10 comprise projecting lugs that extend from the bottom surface of the shell 4 at either end of the line of interaction 28 between the two shell parts 22, 24 of the shell 4 and spanning across the two shell parts 22, 24. Each mounting element 8, 10 thus comprises a portion formed on the first shell part 22 and a portion formed on the second shell part 24. With the shell 4 in an assembled condition, each mounting element 8, 10 presents a flat mounting surface 50, 52 that is operable to engage a wall, floor or other supporting surface on or against which the case 2 is resting. The upper mounting element 8 comprises two mounting openings 54, 56 extending through the mounting element 8 substantially parallel to the longitudinal axis of the cylinder housing portion 14 of the shell 4, one mounting opening 54, 56 on each portion of the mounting element 8. The lower mounting element 10 comprises a single mounting opening 58, extending parallel to the upper mounting openings 24, 26 through a central region of the lower mounting element 10. The lower mounting opening 58 is defined jointly by both portions of the lower mounting element 10. The mounting openings 54, 56, 58 are operable to receive screws, nails, hooks or other suitable mounting projections formed on a wall or other supporting surface.

As seen in FIGS. 1 and 2, strips 60, 62 of photo-luminescent material or paint are provided on an external surface of the shell 4 to enhance visibility of the case 2. The shell 4 may also comprise a window 64 that is aligned with the location of a pressure gauge on a cylinder of breathable gas 20 to be contained within the shell 4. This facilitates easy checking of the pressure of the gas within the cylinder 20 without requiring disassembly of the case 2.

The case 2 of the invention is designed for use with an emergency escape breathing apparatus. Such apparatus comprises a cylinder of breathable gas 20 and a delivery device in the form of a mask or hood (not shown). The mask or hood is designed to fit closely to or over the head of a user and is connected to the cylinder of breathable gas 20 by a flexible supply line. The cylinder comprises or is provided with a valve which, when opened, permits a regulated flow of gas through the supply line and into the mask or hood for delivery to the user. The user is thus provided with an emergency supply of, typically, 10 to 15 minutes of breathable gas, allowing emergency evacuation from a hazardous environment. It will be appreciated that such apparatus is employed only in an emergency, and may therefore be required by users who have little familiarity or training with the apparatus.

In use, the case 2 of the invention is first assembled around the cylinder 20 and the delivery device of the emergency escape breathing apparatus. As seen particularly in FIG. 5, the two halves of the shell 4 of the case 2 are assembled to encase the cylinder of breathable gas 20 within the cylinder housing portion 14 of the shell 4. The two shell parts of the shell 4 are connected together by the first and second bolts 34, 36 and the strap 12 is securely connected to the first and second bolts 34, 36. The two shell parts 22, 24 therefore cooperatively retain the cylinder therebetween within the cylinder housing portion 14 without the need for auxiliary fixings. The supply line and mask or hood (not shown) are connected to the cylinder of breathable gas 20 and are housed within the delivery device retaining portion 16 of the shell 4. In certain embodiments, the case 2 may comprise an activation key, arranged automatically to open the valve of the cylinder and start the flow of breathable gas on opening of the closure 40, or on removal of the mask or hood from the shell 4. If such an activation key is present, it is placed in its operating configuration and the case 2 is then sealed by closing the closure 40. The emergency escape breathing apparatus comprising the case 2 and contained cylinder 20, the delivery device and supply line is then in its stowed condition, ready for storage in case of need. The case 2 may be placed on a horizontal surface or may by suspended on a supporting wall, side wall of a cupboard, or any other appropriate supporting surface via the mounting elements 8, 10 and mounting openings 54, 56, 58. The apparatus may thus be stored visibly and accessibly, yet out of the way for normal operations.

In the event of an emergency causing a hazardous environment, the case 2 is removed from its storage location by a user. The tab or handle 42 of the closure 40 is grasped by the user and pulled to remove the closure 40 from the opening 38. If an activation key is not present, the user manually starts the flow of breathable gas from the cylinder 20 by opening the valve. Otherwise, the breathable gas supply starts automatically. The mask or hood is then removed from the case 2 and placed over the head of the user. It will be appreciated that while the mask or hood is removed from the case 2, the cylinder of gas 20 is non-removable (without disassembling the case) and therefore remains securely held within the case 2. The user then places the body strap 12 around the neck, or over the shoulder, conveniently carrying the case 2 including the cylinder 20 on the body while leaving both hands free for use during evacuation. The user then evacuates the hazardous environment, while breathing safe, breathable gas supplied by the emergency escape breathing apparatus.

It will be appreciated that the case 2 of the invention thus presents a resilient, durable housing for an emergency escape breathing apparatus that is easy to use and store. There is no need for separate storage equipment as the storage solution is built into the apparatus. In addition, the apparatus is sufficiently robust to withstand accidental damage during long periods of storage as well as impact and rugged movement during use. The breathing apparatus of cylinder, mask or hood and supply line remain protected within the rigid case during storage, and the cylinder remains protected within the case during use. The case 2 may be made suitable for environments requiring intrinsically safe equipment through the use of a conductive plastics material for the shell 4.

The invention claimed is:

1. A case for emergency escape breathing apparatus, comprising:

a substantially rigid hollow shell defining a cylinder housing portion for retaining a cylinder of breathable gas and a delivery device housing portion for removably housing a delivery device for the breathable gas supplied by the cylinder, the cylinder housing portion and the delivery device housing portion being in communication, wherein the shell comprises first and second shell parts that in use are assembled around a cylinder of breathable gas so as to cooperatively retain the cylinder therebetween within the cylinder housing portion and to define the delivery device housing portion therebetween; wherein the first and second shell parts comprise two halves of the shell; and an access opening providing access to the interior of the delivery device housing portion, wherein in use with the first and second shell parts assembled around the cylinder of breathable gas, a delivery device can be inserted into and removed from the delivery device housing portion through the access opening, such that when inserted into the delivery device housing portion the delivery device becomes fluidically connected to the cylinder of breathable gas.

2. The case according to claim 1, wherein the first and second shell parts are secured together by at least one bolt.

3. The case according to claim 1, wherein the first and second shell parts are substantially longitudinally coextensive with one another.

4. The case according to claim 1, wherein the first and second shell parts are substantially mirror images of one another.

5. The case according to claim 1, wherein the first and second shell parts join along a longitudinally extending plane.

6. The case according to claim 5, wherein the plane divides or bisects both the cylinder housing portion and the delivery device housing portion.

7. The case according to claim 1, wherein the first and second shell parts comprise cooperating formations which are arranged to engage with one another.

8. The case according to claim 1, wherein the first and second shell parts are joined at a hinge.

9. The case according to claim 1, wherein the shell is formed from a plastics material.

10. The case according to claim 1, wherein the shell is formed from a conductive plastics material.

11. The case according to claim 1, wherein the first and second shell parts are integrally formed with one another.

12. The case according to claim 1, wherein the shell is moulded.

13. The case according to claim 1, wherein the shell further comprises internal fixing elements operable to retain a cylinder of breathable gas within the cylinder housing portion.

14. The case according to claim 1, further comprising an access panel arranged to close the access opening and at least partially detachable from the shell so as to expose the access opening.

15. The case according to claim 14, wherein the access panel comprises a fabric panel.

16. The case according to claim 1, further comprising a strap attached to the shell and arranged to be received on the body of a wearer.

17. The case according to claim 16, wherein the strap is a shoulder strap or a waist strap.

18. The case according to claim 1, further comprising an external mounting element connected to the shell for mounting the case to a mounting surface.

19. The case according to claim 18, wherein the mounting element comprises a projecting lug formed on an external surface of the shell.

20. The case according to claim 19, wherein a mounting recess extends through the lug and which is arranged to receive a mounting projection on a corresponding mounting surface.

21. The case according to claim 18, wherein the mounting element comprises a loop formed on an external surface of the shell.

22. The case according to claim 1, wherein the shell further comprises a viewing window positioned to correspond to the location of a gauge of a cylinder retained within the shell.

23. An emergency escape breathing apparatus comprising:

a case in accordance with claim 1;

a cylinder of breathable gas; and a delivery device fluidically connected to the cylinder by a supply line;

wherein the first and second shell parts are assembled around the cylinder of breathable gas so as to cooperatively retain the cylinder therebetween within the cylinder housing portion; and wherein the delivery device is removably housed within the delivery device housing portion and removable and reinsertable through the access opening.

24. The emergency escape breathing apparatus according claim 23, wherein the delivery device comprises a mask or hood.

25. A case for emergency escape breathing apparatus, comprising:

a substantially rigid hollow shell formed from a plastics material defining a cylinder housing portion for retaining a cylinder of breathable gas and a delivery device housing portion for removably housing a delivery device for the breathable gas supplied by the cylinder, the cylinder housing portion and the delivery device housing portion being in communication, the shell comprising first and second shell parts comprising two halves of the shell which are substantially longitudinally coextensive with one another and which are arranged to assembled around a cylinder of breathable gas so as to cooperatively retain the cylinder therebetween within the cylinder housing portion, and to define the delivery device housing portion therebetween;

an access opening providing access to the interior of the delivery device housing portion, wherein in use, with the first and second parts assembled around thea cylinder of breathable gas a delivery device can be inserted into and removed from the delivery device housing portion through the access opening, such that when inserted into the delivery device housing portion the delivery device becomes fluidically connected to the cylinder of breathable gas;

an access panel arranged to close the access opening and at least partially detachable from the shell so as to expose the access opening; and a strap attached to the shell and arranged to be received on the body of a wearer.

26. An emergency escape breathing apparatus comprising:

a cylinder of breathable gas;

a delivery device fluidically connected to the cylinder by a supply line; and a case comprising:

a substantially rigid hollow shell formed from a plastics material defining a cylinder housing portion which retains the cylinder of breathable gas and a delivery device housing portion which removably houses the delivery device, the cylinder housing portion and the delivery device housing portion being in communication;

the shell comprising first and second shell parts comprising two halves of the shell which are substantially longitudinally coextensive with one another and that are assembled around the cylinder of breathable gas so as to cooperatively retain the cylinder therebetween within the cylinder housing portion, and to define the delivery device housing portion therebetween;

an access opening providing access to the interior of the delivery device housing portion so that, with the two halves of the shell assembled around the cylinder of breathable gas the delivery device can be inserted into and removed from the delivery device housing portion through the access opening;

an access panel arranged to close the access opening and at least partially detachable from the shell so as to expose the access opening; and a strap attached to the shell and arranged to be received on the body of a wearer.

* * * * *